US005160025A

United States Patent [19]

Greenawald

[11] Patent Number: 5,160,025

[45] Date of Patent: Nov. 3, 1992

[54] BATTERY SHIPPING CONTAINER

[75] Inventor: Michael A. Greenawald, McMurray, Pa.

[73] Assignee: Uarco Incorporated, Barrington, Ill.

[21] Appl. No.: 743,117

[22] Filed: Aug. 9, 1991

[51] Int. Cl.[5] ..... B65D 85/42

[52] U.S. Cl. ..... 206/333; 206/204; 206/386; 206/523; 229/23 A

[58] Field of Search ..... 206/333, 204, 811, 521, 206/523, 386, 600; 229/23 A, 150, 23 R, 199

[56] References Cited

U.S. PATENT DOCUMENTS

| | | | |
|---|---|---|---|
| Re. 19,180 | 5/1934 | Boeye | 206/333 X |
| Re. 19,181 | 5/1934 | Boeye | 206/333 X |
| 1,186,859 | 6/1916 | Stephenson | 220/507 X |
| 1,280,657 | 10/1918 | Burgess | 206/333 |
| 1,655,071 | 1/1928 | Oppenheim | 206/521 X |
| 1,822,899 | 9/1931 | Malis | 206/521 |
| 1,850,509 | 3/1932 | Lengsfield | 229/199 X |
| 1,894,226 | 1/1933 | Ross | 229/150 X |
| 2,022,595 | 11/1935 | Gowing | 206/333 X |
| 2,277,773 | 3/1942 | McGrath | 229/23 A |
| 2,707,721 | 5/1955 | Anderson et al. | 206/333 X |
| 3,096,879 | 7/1963 | Schumacher | 206/523 |
| 3,146,132 | 8/1964 | Nathan | 206/333 X |
| 3,344,973 | 10/1967 | Studen | 206/523 |
| 3,531,327 | 9/1970 | Moos | 206/523 X |
| 3,650,459 | 3/1972 | Tucker | 229/23 A |
| 3,670,949 | 6/1972 | Galanes | 229/150 X |
| 4,306,653 | 12/1981 | Fales | 206/521 X |
| 4,942,963 | 7/1990 | Gibellini | 206/333 |
| 4,964,509 | 10/1990 | Insley et al. | 206/204 |

*Primary Examiner*—Bryon P. Gehman

*Attorney, Agent, or Firm*—Wood, Phillips, VanSanten, Hoffman & Ertel

[57] ABSTRACT

A container for transporting wet batteries in aircraft, including a wax coated cardboard box portion having a selected width and a selected depth and secured on its bottom to a wax coated cardboard pedestal base which has a width at least 1.5 times the box portion selected width and a depth at least 1.5 times the box portion selected depth. The box portion also includes a lid structure in the top of the box portion and securable in a closed position defining a completely enclosed space for securing a battery for transport. Two absorbent blankets are provided within the box portion for wrapping around a battery, and a two sealable impermeable bag are also provided for enclosing a blanket wrapped battery within the enclosed space during transport of the battery. An absorbent foam liner is secured within the box portion surrounding the enclosed space.

16 Claims, 3 Drawing Sheets

BATTERY SHIPPING CONTAINER

BACKGROUND OF THE INVENTION

1. Technical Field

The present invention is directed toward shipping containers, and more particularly toward containers for shipping acid filled batteries.

2. Background Art

In most air transport, passengers requiring wheelchairs are required to store their wheelchairs separately from the passenger compartment. Further, extra care must be taken with electrically operated wheelchairs powered by batteries, as the batteries are typically "wet" batteries containing powerful acid which could cause damage if spilled. Depending on the circumstances, spillage of damaging battery acid could even result in failure to crucial aircraft components (for example, aircraft electronics) with catastrophic results.

As a result of this potential, the batteries are removed from electrically operated wheelchairs being transported in aircraft and separately stored for protection. Typically, the batteries have been separately stored in boxes kept in the luggage compartment of the aircraft, where the boxes have a foam lining or other material intended to absorb any leaked battery acid (such as kitty litter).

Of course, boxes using loose absorbent material are messy to use. Even in the best conditions, the transported battery can end up with the material stuck all over it. Also, it is almost unavoidable that the small grains of the material will end up spilling, especially when the box is opened during packing or unpacking.

Further, boxes using loose absorbent materials are difficult to use. That is, supplying the proper amount of material needed for such boxes complicates maintenance of proper inventory of such boxes, particularly if the boxes are maintained separately from the absorbent material. Further, while inventory can be simplified by providing each box with its own portion of absorbent material already in it, it is then difficult to get the battery down into the center of the material. Still further, even if a battery is properly located initially within the loose material for shifting, the battery can shift within such material, with the result being that battery acid leaking to one side of the container will encounter little, if any, of the protective material required to prevent its leaking from the container.

In addition to these problems with containers using loose materials, it has also been found that such containers (whether used with loose absorbent materials or not) are still fully reliable only in ideal conditions in which only minimal amounts of acid leak from the battery. Unfortunately, such ideal conditions are not always encountered in air travel. For example, during flights in which the aircraft attitude is changed abruptly, whether due to weather or other conditions, the prior art boxes have occasionally been found to tip over. When this occurs, the battery acid essentially pours from the battery with the result often being that the acid soaks through the foam or other absorbent material in the box. When that occurs, the acid damages whatever it touches, typically other people's luggage stored near the battery.

Obviously, such occurrences are upsetting to the people who have their luggage damaged, so that the leakage not only results in physical damage to property but also in even greater damage to the reputation and good will of the airline (such incidents are not soon forgotten by the "victims").

Still further, persons dependent on the powered wheelchair will also be upset to find, upon their arrival at their destination, that the battery is damaged and thus the wheelchair which they rely on and which was in perfectly good shape when they entrusted it to the airline is now inoperable. In such situations, the airlines are faced with the choice of either keeping a supply of all types of batteries on hand at all of their destinations for replacement, or leaving the person stranded without use of their wheelchair. The first option is prohibitively costly. The second option should be unacceptable not merely for "moral" reasons but also for business reasons—today's airlines are especially competitive and thus especially reliant on getting repeat passengers from their good will and positive reputation.

Of course, there are many different configurations of containers in other fields which reliably seal hazardous materials (for example, toxic and nuclear wastes). However, such containers are often difficult and clumsy to use and, most importantly, require use of expensive materials, expensive components, and/or expensive manufacturing techniques. Further, such containers are often configured without consideration to the overall weight of the container, whereas weight is a particularly important consideration in air transport.

The present invention is directed toward overcoming one or more of the problems set forth above.

SUMMARY OF THE INVENTION

In one aspect of the present invention, a container for transporting wet batteries in aircraft is provided, including a wax coated cardboard box portion having a selected width and a selected depth and secured on its bottom to a wax coated cardboard pedestal base which has a width at least 1.5 times the box portion selected width and a depth at least 1.5 times the box portion selected depth. The box portion also includes a lid structure in the top of the box portion, which structure is securable in a closed position defining a completely enclosed space for securing a battery for transport, and an absorbent liner within the box portion surrounding the enclosed space for securing a battery.

In another aspect of the present invention, the liner is a foam layer including foam sections secured to the bottom and all sides of the box portion and to the lid structure on top of the box portion.

In still another aspect of the present invention, an absorbent blanket is provided within said box portion for wrapping around a battery, and a sealable impermeable bag is also provided for enclosing a blanket wrapped battery within the enclosed space during transport of the battery.

Yet another aspect of the present invention is the provision of a second absorbent blanket and second sealable impermeable bag.

It is an object of the present invention to provide an inexpensive container for transporting a wet battery in an aircraft.

It is another object of the present invention to provide a low weight battery transport container for use in aircraft.

It is still another object of the present invention to provide a battery container which my be easily and inexpensively inventoried.

It is yet another object of the present invention to provide for the quick and easy loading of a wet battery into the container, and for the easy loading of the container in an aircraft.

Another object of the present invention is to minimize the potential of spilling or otherwise damaging wet batteries during transport in an aircraft, even in turbulent conditions.

Still another object of the present invention is to provide reliable protection against battery acid leaking onto and damaging other items on the aircraft such as luggage or aircraft components.

It is therefore a related object of the present invention to prevent all unnecessary and avoidable damage to the reputation and good will of the airline transporting the battery.

DESCRIPTION OF THE PREFERRED EMBODIMENT

Figure 1:
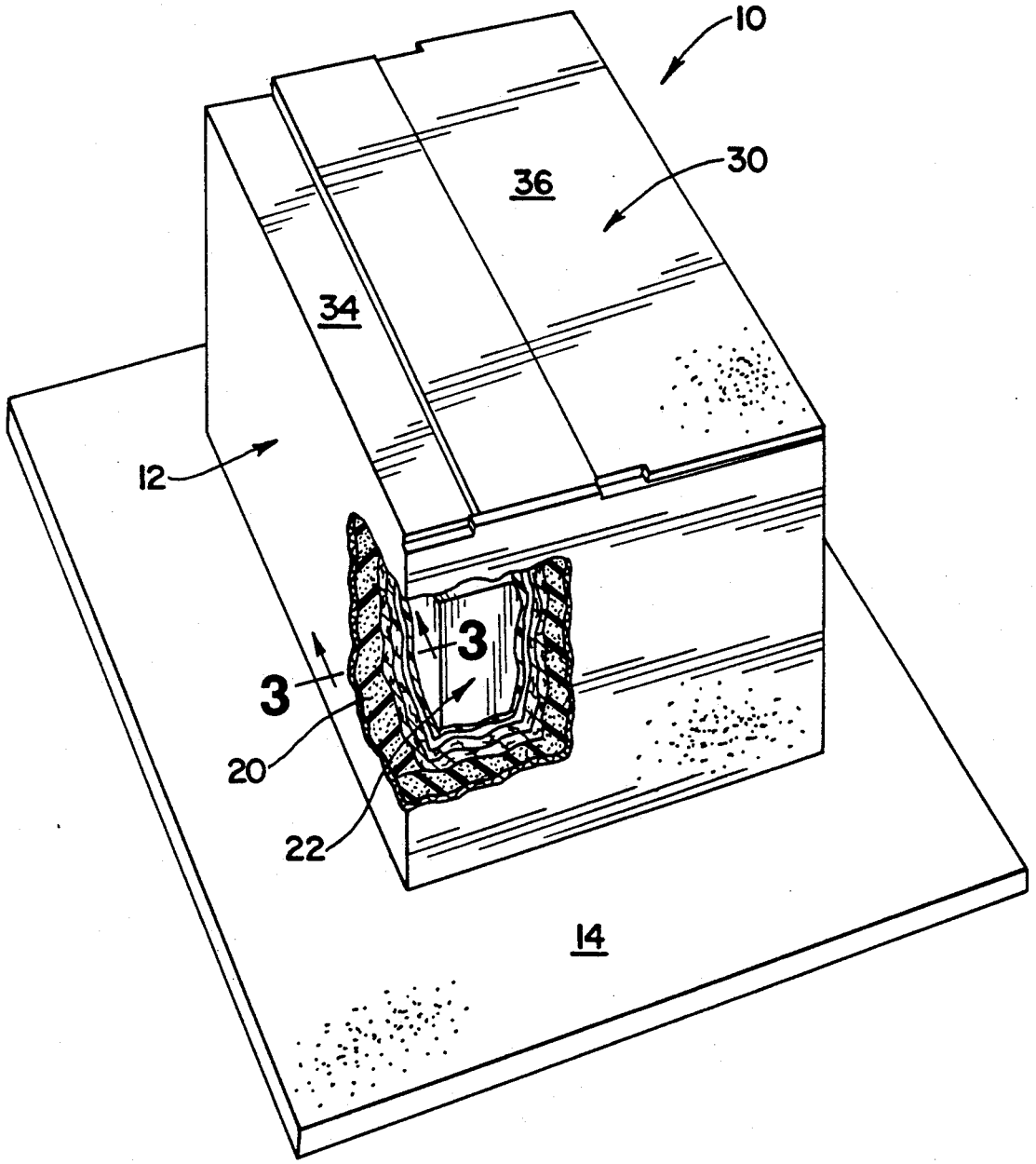
FIG. 1 is a perspective, partially broken-away view of the container of the present invention.
Figure 2:
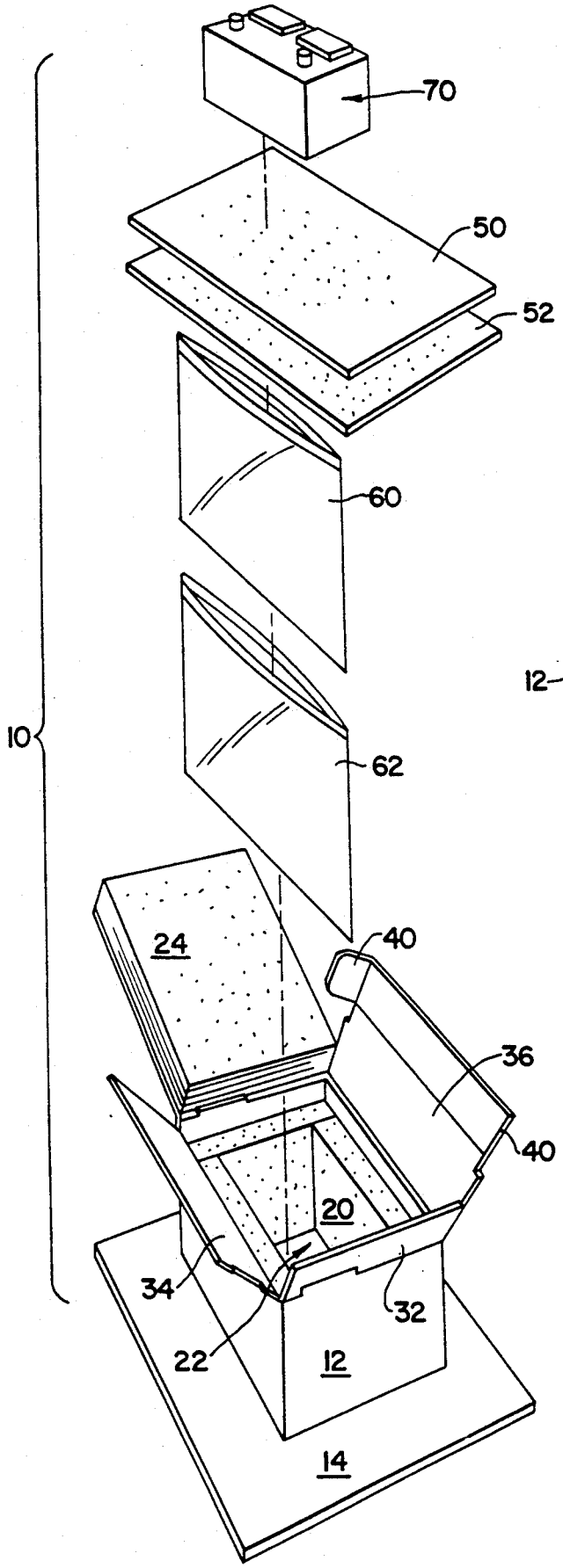
FIG. 2 is an exploded view of the container of the present invention.

A container 10 for transporting wet batteries in aircraft is best shown in FIGS. 1 and 2, and includes a box portion 12 secured to a pedestal base 14.

While any number of materials would be suitable for the box portion 12 and base 14, it is desirable to minimize the cost of the container 10. In that respect, it has been found that wax coated corrugated cardboard is not only inexpensive but also functions adequately. Specifically, the box portion 12 may be a basic cardboard box structure (preferably wax coated on both the inside and the outside, and with other refinements as hereafter described. Further, the base 14 is preferably multiple layers of such wax coated cardboard suitably secured together (such multiple layers strengthening the base 14 against bending during use, which bending is undesirable as will become apparent).

A suitable shipping label (not shown) can be attached to the box portion 12 (or base 14) so that the owner of the battery contained therein can be readily identified when the container 10 reaches its destination. For example, a pressure sensitive adhesive pouch can be adhered to the box portion 12 to provide a readily visible place in which any identification documents can be reliably secured to travel with the container 10.

Secured to the interior walls of the box portion 12 is an absorbent liner 20 (such as an acid resistant foam) defining an enclosed space 22 for a battery to be transported.

Figure 7:
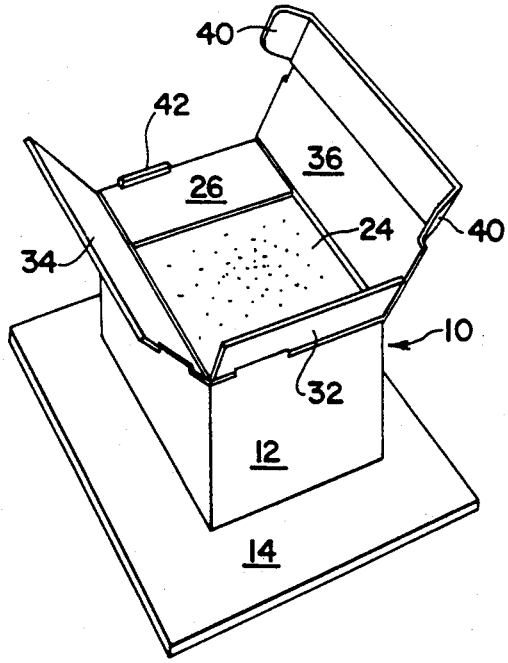
Figure 8:
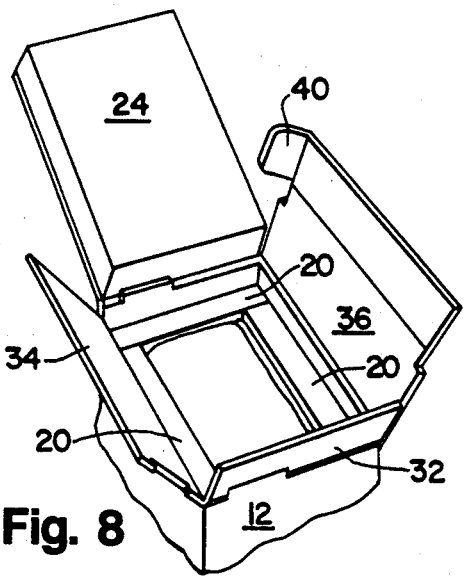

In order to ensure a complete closure of the enclosed space, a liner section 24 is preferably secured to one of the flaps 26 of the lid structure of the box portion 12 (see particularly FIGS. 2, 7 and 8). This structure thus ensures that airline personnel will not set aside the liner section 24 when packing a battery in the container 10 and then inadvertently fail to replace the liner section 24 when closing the container lid structure. Accordingly, the structure of the present invention ensures that the packed battery will be surrounded on all six sides by an absorbent liner 20 which protects against battery acid from escaping the container should any such acid leak from the battery.

Figure 5:
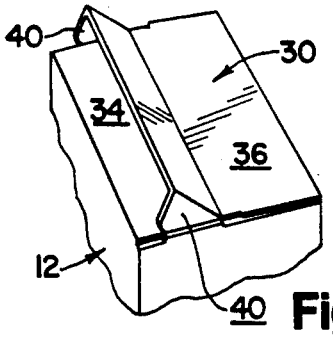
Figure 6:
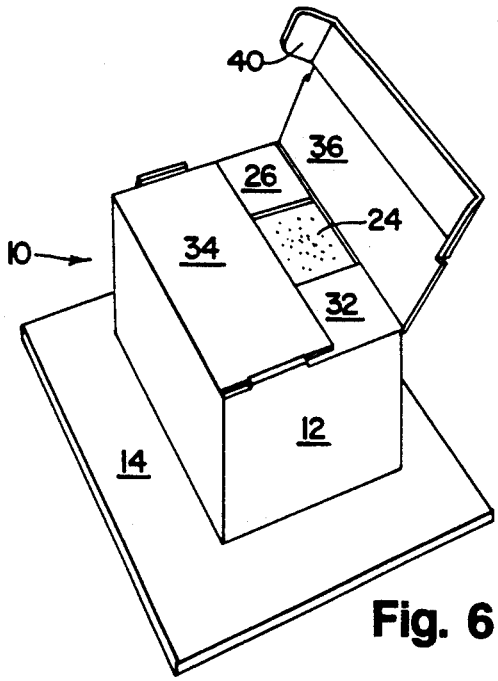

Referring more specifically to the box portion lid structure 30, it is preferable that flaps 26, 32, 34, 36 be provided on each side of the box portion 12, with each flap folding inward for closing. Further, as best illustrated in FIGS. 5 and 7, one flap 36 includes tabs 40 on both sides, which tabs 40 are receivable in slots 42 in the box portion 12 to securely maintain the lid structure 30 closed during transport while also allowing for easy manual opening of the lid structure 30 when desired (for example, when packing or unpacking a battery).

The configuration of the flaps shown in the Figures provides a number of advantages. That is, in addition to ensuring that the liner completely encloses the battery space 22, it will be readily apparent to any user how to properly close the lid structure 30. Also, the lid structure 30 is self sealing so that, when closed with a battery enclosed therein, there is virtually no possibility that the lid structure 30 will be inadvertently and undesirably opened. Further, by eliminating any need for adhesive tape or the like to close the container, there is no need to keep a supply of tape handy. Still further, this eliminates the possibility that inadequate (insufficiently strong) tape will be used, thereby eliminating any danger of the tape breaking and the box portion 12 opening up during transport. As a result, the lid structure 30 provides for virtually foolproof use resulting in a reliable closure.

Two absorbent, felt blankets 50, 52 are also provided in the preferred embodiment of the container 10. Felt blankets have been found to function relatively well in resisting deterioration while absorbing abrasive liquids such as battery acid.

Two generally impermeable bags 60, 62 are further provided in the preferred embodiment of the container 10. Preferably, the bags 60, 62 are made of a suitable flexible plastic material such as polyethylene.

Each bag 60, 62 also is provided with a suitable structure for sealing the bag closed. While there are many suitable known ways for sealing such bags 60, 62, in the preferred embodiment, each bag 60, 62 is provided with an integral seal structure (such as those commonly known as "zip locks"). Use of an integral seal structure minimizes the components required for this container 10, thereby minimizing the possibility of difficulties arising from loss of container components prior to use (just as the lid structure 30 eliminates any need for tape or the like).

The present invention as described above thus provides ideal use.

The container 10 is itself a complete kit which may be easily and reliably properly used whenever needed to transport a wheelchair battery. Specifically, each container 10 provided in the disparate terminal locations of an airline can be relied upon to include all of the components necessary for use, including the blankets 50, 52 and bags 60, 62 contained in the box portion enclosed space 22. Therefore, there is no danger that the container 10 will not be properly used due to missing components or the possible use of insufficient additional components to be supplied at each terminal. Further, maintaining an appropriate inventory of these containers is simplified (not an unimportant factor since such containers are usually required to be located at numerous airline terminals throughout the world). Still further, because of the low cost of the component materials, a significant inventory may be maintained at minimum expense notwithstanding any need to maintain an inventory at many different terminals across the world.

Further, packing a battery in the container 10 of the present invention is both simple and easy. Specifically, once the battery 70 (see FIG. 2) to be shipped is disconnected from the wheelchair, it is first wrapped in the two felt blankets 50, 52 and then enclosed inside both bags 60, 62, each of which are suitably sealed. (Alternatively, the battery 70 could be wrapped in one blanket 50, enclosed in one bag 60, that bag 60 wrapped in the other blanket 52, and the entire bundle enclosed in the other bag 62). Suitable instructions can be printed a flap of the box portion lid structure 30 if desired to make clear how the blankets 50, 52 and bags 60, 62 are to be used.

The bagged bundle (with the battery 70 in the middle) is then placed in the enclosed space 22 of the box portion, and the lid structure 30 is closed (thereby also locating the liner section 24 over the space 22) and secured by the tabs 40.

As a result, when a battery 70 is so shipped, the container 10 is stabilized against any tipping by the pedestal base 14. Not only does the base 14 simply widen the base which secures against tipping, but it also will often have other items such as luggage resting on it to provide still further stability against undesirable tipping. Of course, the base 14 also serves as a clear indication to the baggage handlers to ensure that the container will not be unwittingly placed on its side or upside down. Accordingly, the primary goal of minimizing the possibility of spilling or otherwise damaging wet batteries during transport in an aircraft is accomplished. This is also accomplished through use of a minimal weight structure, a particularly important consideration in all air travel.

Figure 3:
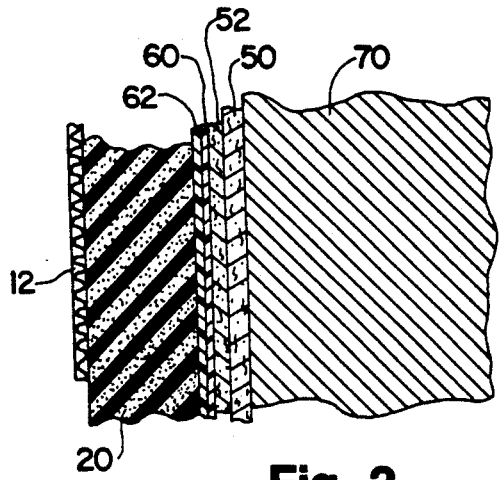
FIG. 3 is a broken cross-sectional view taken along line 3—3 of FIG. 1.
Figure 4:
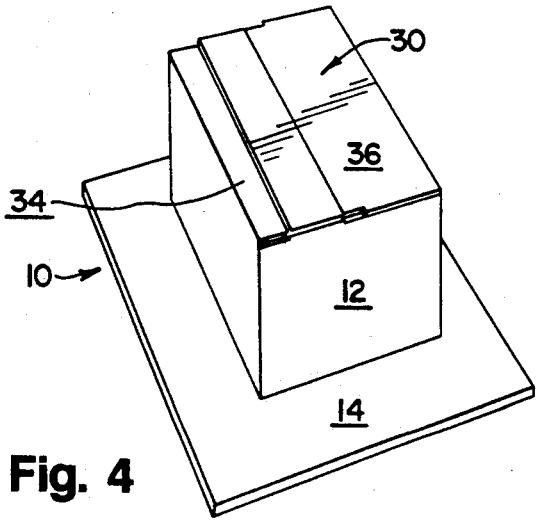
FIGS. 4–8 are perspective views sequentially showing the container of the present invention as it is opened.

Still further, the container 10 provides reliable protection against battery acid leaking onto and damaging other items on the aircraft such as luggage or aircraft components even in the unlikely event that a battery leaks acid (of course, a defective battery could leak acid even if the battery is kept upright at all times, particularly in view of the uncommon temperatures and pressures sometimes encountered in aircraft storage areas). Specifically, as best illustrated in FIG. 3, the battery 70 is enclosed in numerous protective layers (i.e., a first felt blanket 50, a second felt blanket 32, a first impermeable bag 60, a second impermeable bag 62, a foam liner 20, and wax coated cardboard), with the result being that battery acid will not escape the container 10 even should it leak from the battery 70.

In short, this container 10 provides security against tipping and against leakage even in the unlikely event of tipping. Further, this security is provided with an inexpensive, light, and easy to use container.

Still other aspects, objects, and advantages of the present invention can be obtained from a study of the specification, the drawings, and the appended claims.

I claim:

1. A container for transporting wet batteries in aircraft, comprising:

a box portion having a selected width and a selected depth and further including a lid structure in the top of the box portion, means for securing the lid in a closed position defining a completely enclosed space for securing a battery for transport, and an absorbent liner within the box portion surrounding the enclosed space for securing a battery; and a pedestal base secured to the bottom of the box portion, said pedestal base having a width at least about 1.5 times the box portion selected width and a depth at least about 1.5 times the box portion selected depth.

2. The container of claim 1, wherein said box portion and said pedestal base are made of wax-coated corrugated cardboard.

3. The container of claim 1, wherein:

said lid structure comprises flaps on all sides, said flaps being folded inwardly over the box portion top when defining the completely enclosed space, with one of said flaps being the first to fold inwardly and a second of said flaps being the last to fold inwardly;

said securing means comprises tabs on said second flap receivable in slots in said box portion; and said liner comprises a foam layer within the box portion secured to the bottom and all sides of the box portion and to said one flap.

4. The container of claim 3, wherein said box portion and said pedestal base are made of wax-coated corrugated cardboard.

5. A container for transporting wet batteries in aircraft, comprising:

a box portion including a lid structure in the top of the box portion, means for securing the lid in a closed position defining a completely enclosed space for securing a battery for transport, and an absorbent liner within the box portion surrounding the enclosed space for securing a battery;

a pedestal base secured to the bottom of the box portion;

a first absorbent blanket within said box portion for wrapping around a battery; and a first sealable impermeable bag within said box portion for enclosing a blanket-wrapped battery within said completely enclosed space during transport of the battery.

6. The container of claim 5, wherein said box portion and said pedestal base are made of wax-coated corrugated cardboard.

7. The container of claim 5, further comprising:

a second absorbent blanket within said box portion for wrapping around a battery wrapped in said first blanket; and a second sealable impermeable bag within said box portion for enclosing the first bag and blanket-wrapped battery within said completely enclosed space during transport of the battery.

8. The container of claim 5, wherein said first bag is a plastic enclosure having an opening therein and means for sealing the bag opening.

9. The container of claim 5, wherein said box portion has a selected width and a selected depth, and said pedestal base has a width at least 1.5 times the box portion selected width and a depth at least 1.5 times the box portion selected depth.

10. A container for transporting wet batteries in aircraft, comprising:

a box portion including a lid structure in the top of the box portion, said lid structure comprising flaps on all sides, said flaps being folded inwardly over the box portion top when defining the completely enclosed space, with one of said flaps being the first to fold inwardly and a second of said flaps being the last to fold inwardly means for securing the lid in a closed position defining a completely enclosed space for securing a battery for transport, said securing means comprising tabs on said second flap receivable in slots in said box portion, and an absorbent liner within the box portion surrounding the enclosed space for securing a battery, said liner comprising a foam layer within the box portion secured to the bottom and all sides of the box portion and to said one flap;

a pedestal base secured to the bottom of the box portion;

a first absorbent blanket within said box portion for wrapping around a battery; and a first sealable impermeable bag within said box portion for enclosing a blanket-wrapped battery within said completely enclosed space during transport of the battery.

11. The container of claim 10, further comprising:

a second absorbent blanket within said box portion for wrapping around a battery wrapped in said first blanket; and a second sealable impermeable bag within said box portion for enclosing the first bag and blanket-wrapped battery within said completely enclosed space during transport of the battery.

12. The container of claim 11, wherein said first and second bags are plastic enclosures with an opening in each, further comprising means for sealing the opening of each bag.

13. An inexpensive container kit for use in transporting wet batteries in aircraft, comprising:

a rectangular box portion having four sides, a top, and a bottom, said box portion further having a selected width and a selected depth;

an acid-resistant foam layer secured to the bottom and all sides within the box portion to thereby surround and define an open-top compartment for a battery during transport;

a section of acid-resistant foam disposed within the box portion over the compartment open top;

a first absorbent blanket within said compartment for wrapping around a battery;

a first sealable impermeable bag within said compartment for enclosing a blanket-wrapped battery within said compartment during transport of the battery;

flaps on top of said box portion sides and foldable inwardly to close the box portion top;

means for securing the lid flaps in a closed position; and a pedestal base secured to the bottom of the box portion and having a width at least 1.5 times the box portion selected width and a depth at least 1.5 times the box portion selected depth.

14. The container kit of claim 13, wherein said box portion and said pedestal base are made of wax-coated corrugated cardboard.

15. The container kit of claim 13, further comprising:

a second absorbent blanket within said compartment for wrapping around a battery wrapped in said first blanket; and a second sealable impermeable bag within said compartment for enclosing the first bag and blanket-wrapped battery within said completely enclosed space during transport of the battery.

16. The container kit of claim 15, wherein said first bag is a flexible plastic enclosure with an opening therein and means for sealing the bag opening.

* * * * *